US006865351B2

(12) United States Patent
Gogate et al.

(10) Patent No.: US 6,865,351 B2
(45) Date of Patent: Mar. 8, 2005

(54) METHOD OF USING A FUSER FOR A COLOR ELECTROPHOTOGRAPHIC PRINTER

(75) Inventors: Hrishikesh P. Gogate, Lexington, KY (US); John W. Kietzman, Lexington, KY (US); Calvin D. Murphy, Lexington, KY (US); Jerry W. Smith, Irvine, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/425,312

(22) Filed: Apr. 29, 2003

(65) Prior Publication Data

US 2004/0218942 A1 Nov. 4, 2004

(51) Int. Cl.[7] ..... G03G 15/20
(52) U.S. Cl. ..... 399/69; 399/329
(58) Field of Search ..... 399/67, 68, 69, 399/70, 322, 329; 347/156

(56) References Cited

U.S. PATENT DOCUMENTS

| | | | | |
|---|---|---|---|---|
| 4,027,962 A | | 6/1977 | Mailloux | |
| 4,053,216 A | | 10/1977 | Mailloux | |
| 4,053,217 A | | 10/1977 | Mailloux | |
| 5,365,314 A | * | 11/1994 | Okuda et al. | 399/69 |
| 5,436,712 A | | 7/1995 | Wayman et al. | |
| 5,450,182 A | | 9/1995 | Wayman et al. | |
| 5,499,088 A | | 3/1996 | Menjo | |
| 5,669,038 A | * | 9/1997 | Kishimoto | 399/67 |
| 5,732,318 A | | 3/1998 | Natsuhara et al. | |
| 5,765,085 A | | 6/1998 | Law et al. | |
| 5,852,763 A | | 12/1998 | Okuda et al. | |
| 5,860,051 A | | 1/1999 | Goto et al. | |
| 5,907,348 A | | 5/1999 | Ogasawara et al. | |
| 5,907,743 A | * | 5/1999 | Takahashi | 399/69 |
| 5,999,787 A | | 12/1999 | Finsterwalder et al. | |
| 6,040,558 A | * | 3/2000 | Yamazaki | 399/329 X |
| 6,090,305 A | | 7/2000 | Balch et al. | |
| 6,108,500 A | | 8/2000 | Ohkama et al. | |
| 6,157,806 A | | 12/2000 | Elbert et al. | |
| 6,160,975 A | * | 12/2000 | Bartley et al. | 399/69 |
| 6,175,699 B1 | * | 1/2001 | Kato et al. | 399/69 |
| 6,185,389 B1 | | 2/2001 | Bartley et al. | |
| 6,201,945 B1 | | 3/2001 | Schlueter, Jr. et al. | |
| 6,243,559 B1 | | 6/2001 | Kurotaka et al. | |
| 6,266,510 B1 | | 7/2001 | Curry et al. | |
| 6,272,310 B1 | | 8/2001 | Blair et al. | |
| 6,285,838 B1 | | 9/2001 | Able et al. | |
| 6,304,731 B1 | | 10/2001 | Able et al. | |
| 6,384,378 B2 | | 5/2002 | Natsuhara et al. | |
| 6,392,197 B2 | | 5/2002 | Natsuhara et al. | |
| 6,564,033 B2 | * | 5/2003 | Zhou et al. | 399/329 |
| 6,671,470 B2 | * | 12/2003 | Suzuki et al. | 399/69 |

FOREIGN PATENT DOCUMENTS

| | | |
|---|---|---|
| JP | 06011939 A | 1/1994 |

* cited by examiner

*Primary Examiner*—Sandra L. Brase
(74) *Attorney, Agent, or Firm*—Taylor & Aust, P.C.

(57) ABSTRACT

A fuser for fusing an image to print media in a color electrophotographic printer. The fuser includes an endless idling belt defining an inner loop, and a ceramic heater positioned in contact with the belt, within the inner loop. A pressure roller defines a nip with the belt. The belt includes a compliant layer for conforming to variations in toner pile height. Operating methods improve printer performance by reducing variations in media transport velocity through the fuser.

17 Claims, 2 Drawing Sheets

METHOD OF USING A FUSER FOR A COLOR ELECTROPHOTOGRAPHIC PRINTER

BACKGROUND OF THE INVENTION

1. Field of the Invention

The present invention relates to electrophotographic printers, and, more particularly, to fusers in color electrophotographic printers capable of printing color transparencies.

2. Description of the Related Art

In an electrophotographic (EP) printer, unfused toner particles are electrostatically attracted to the media to form an image. In order for the image to be fixed permanently, the media and toner must be fused. During fusing, by combination of high temperature and pressure, the toner is melted and forced to adhere to the media.

In printing color transparencies, the fusing requirement is more stringent than merely ensuring that the toner adheres to the media. With multiple layers of toner, more energy is required to fuse the toner than in fusing a single layer of toner for monochrome printing. Unfused toner is opaque, and becomes transparent only upon application of sufficient heat. For a black transparency, under fusing, with some toner remaining opaque, is not problematic. However, for a high quality color transparency, sufficient energy must be added to the media and toner such that the toner becomes transparent. The ability to mix colors and the ability to produce good quality transparencies depends on the ability to make the toner transparent, which requires that all of the toner be adequately fused and that the toner surface be smooth.

The trend in current printer technology has been to reduce standby power requirements and reduce warm up times for the fuser. For this reason, a belt fuser with a ceramic heater is highly desirable. Due to the low thermal mass of such a fuser, it has a very short warm up time, and no standby mode is required. Belt fusers with ceramic heaters consume less overall power than other types of fusers and have a lower initial cost. This type of fuser has been used in several monochromatic printing applications; however, this type of fuser has not been successfully implemented for a versatile color printing application. Implementation for printing color transparencies has presented particular difficulties. Color fusers have to fuse a much higher toner mass/area ratio. The higher coverage presents two challenges; first all the layers of toners must be adequately fused, and second the fused toner must release cleanly from the belt surface. Color prints, and especially transparencies, are more sensitive to print quality defects than monochrome prints. For color transparencies, the toner must be smooth and free of surface defects that can scatter light, making the image appear "dirty" or out of focus. Most color fusers, therefore, are compliant hot roll fusers, which are expensive and slow to warm up. In more recent designs, induction heaters have been used in belt fusers. With an induction heater, the belt and heater are expensive, increasing the overall printer cost.

A fuser must supply sufficient heat to adequately fuse the toner, and must also remain below the release temperature limit, which is the temperature above which offset causes the toner to adhere to the fuser belt. Exit geometry can be used to aid in peeling the media from the fuser belt; however, it is desirable to expand the operating window, that is the temperature range between the minimum temperature for adequate fusing and the temperature at which unacceptable offset occurs.

Controlling the velocity of the media through the machine is an important function for all fusers, especially in compact color EP printers where the available space is minimal. Media handoff between the media transport belt and fuser is critical. If the speed from the media transport belt is faster than the fuser speed, the media will bubble and the surface can scrub against non-functioning machine surfaces, smearing the toner. If the media transport belt speed is slower than the fuser speed, the image can be smeared either in the developer or fuser nip. In an idling belt type fuser, unique problems can occur as a result of the fact that the pressure roller drives the media, which in turn drives the fuser belt. As the ceramic heater adds energy to the pressure roller, the material thereof is caused to expand, and the outer diameter increases, increasing the speed of the media. To meet the desirable goals of quick first copy time, the pressure roller does not come to a steady state temperature before printing begins, and the paper velocity in the fuser nip can change significantly from the first page to subsequent pages after steady state temperature has been achieved. Minimizing the variation in velocity is desirable.

What is needed in the art is an electrophotographic printer with a fuser having a fast warm up time, which fuses color images sufficiently even for transparencies, and which minimizes velocity variation through the fuser during prolonged operation.

SUMMARY OF THE INVENTION

The present invention provides an idling belt fuser for EP color printers with an improved heater control for improved performance.

The invention provides, in one form thereof, a method of fusing toner particles to print media in a color electrophotographic printer, with steps of providing a heater within a loop of an endless belt having a compliant layer therein; energizing the heater; transferring heat via conduction from the heater, through the belt, and to a pressure roller against the belt; de-energizing and re-energizing the heater for selective current half-cycles to reduce the suddenness of heat transfer through the belt; and transporting the print media through a nip defined between the belt and the pressure roller.

The invention provides, in another form thereof, a method of fusing toner particles to print media in an electrophotographic printer, with steps of providing a heater within an inner loop of an endless belt, and a pressure roller defining a nip with the belt; determining a heater set temperature; preheating the belt and pressure roller by energizing the heater to a temperature at least about 25° C. above the set temperature; transporting the print media through the nip defined between the belt and pressure roller; and fusing the toner particles to the print media using heat from the pressure roller and belt.

The invention provides, in a further form thereof, a method of fusing toner particles to print media in an electrophotographic printer, with steps of providing a heater within an inner loop of an endless belt, and a pressure roller defining a nip with the belt; determining a fuser pressure roller steady state temperature for proper fusing; determining a fuser pressure roller existing temperature; comparing the steady state temperature to the existing temperature; energizing a heater within an inner loop of an endless belt if the existing temperature is more than about 10 degrees C. below the steady state temperature; delaying energizing the heater if the existing temperature is not at least about 10 degrees C. below the steady state temperature; transporting the print media through the nip defined between the belt and the pressure roller; and fusing the toner particles to the print media using heat from the pressure roller and the belt.

The invention provides, in a still further form thereof, a method of fusing toner particles to print media in an electrophotographic printer having an idling belt defining a loop, a heater in heat transfer relationship with the belt inside the loop and a pressure roller defining a nip with the belt. The method has steps of energizing the heater to heat the belt and pressure roller; periodically de-energizing and re-energizing the heater; determining a set temperature for proper fusing; detecting an existing temperature; comparing the set temperature to the existing temperature; transporting the print media to the nip; delaying the step of re-energizing the heater until the existing temperature falls below the set temperature by an amount about equal to a temperature rise resulting from re-energizing the heater before the print media reaches the nip; and fusing the toner particles to the print media using heat from the pressure roller and the belt.

The invention provides, in yet another form, a method of fusing toner particles to print media in an electrophotographic printer having an idling belt defining a loop, a heater in heat transfer relationship with the belt inside the loop and a pressure roller defining a nip with the belt. The method steps include determining an existing fuser pressure roller temperature; comparing the existing pressure roller temperature to a pre-established temperature limit; ascertaining the number of individual pieces of media in a print job; and accumulating print jobs until a total number of at least three pieces of print media are in the accumulated print jobs if the pressure roller existing temperature exceeds the pre-established temperature limit.

An advantage of the present invention is that the pressure roller in a fuser is warmed quickly.

Another advantage is that the variations in the pressure roller temperature are reduced.

Yet another advantage is providing improved print quality.

Still another advantage is saving energy and minimizing variations in the velocity of media transport through the fuser under varying operating conditions.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
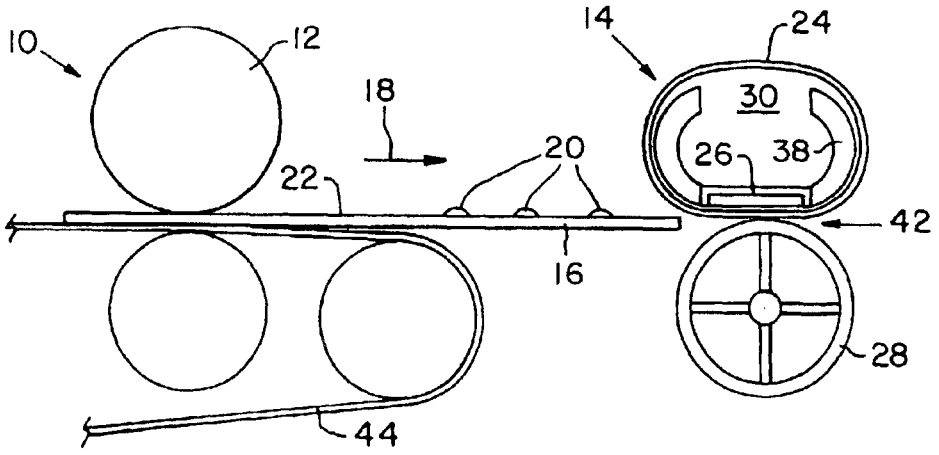
FIG. 1 is a schematic view in elevation of an electrophotographic printer having a fuser structure an operated in accordance with the present invention.

Referring now to the drawings and particularly to FIG. 1, there is shown a schematic illustration of a portion of an EP printer 10 of the present invention. EP printer 10 includes a photoconductive (PC) member 12, a fuser 14, and a paper feed assembly (not specifically shown) which moves print media 16 through EP printer 10. In the embodiment shown, PC member 12 is in the form of a PC drum, but may also be in the form of a PC belt or the like. Further, in the embodiment shown, print media 16 is in the form of paper, but may also be in the form of a transparency, card stock, envelope, etc. The paper feed assembly moves print media 16 in an advance direction through EP printer 10, as indicated by arrow 18.

Fuser 14 fuses toner particles 20 defining an image to a toner side 22 of each print media 16. Toner particles 20 may be monochrome particles transferred to print media 16 from PC drum 12, or may be different colors of particles (e.g., cyan, magenta, yellow and/or black particles) deposited on print medium 16 from multiple PC drums 12, or PC members of a different type. The present invention has particular utility in printing color images on print media 16 of all types, including transparencies.

Figure 4:
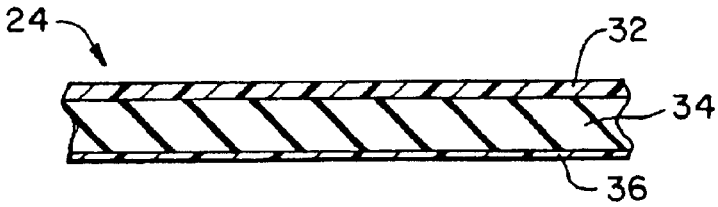
FIG. 4 is a cross-sectional view of the fuser belt shown in FIG. 1.

Fuser 14 includes an endless belt 24, heater 26 and pressure roller 28. Belt 24 defines an inner loop 30. In the embodiment shown in FIG. 4, belt 24 has a polyimide base 32, and, to improve the degree to which belt 24 conforms to the varying heights of the various piles of toner particles 20, belt 24 is provided with a compliant rubber layer 34. Various silicone or fluorosilicone rubbers are suitable for rubber layer 34, which shall be jointly referred to hereinafter as "silicone". Rubber layer 34 thickness of at least about 80 microns, and preferably about 160 microns on a standard monochrome belt base layer 32 of polyimide having a thickness of between approximately 40 to 70 microns, preferably having a thickness of 50 to 60 microns, has been found to provide the necessary compliance for consistent fusing of toner piles, even on color transparencies. Belt 24 preferably is covered with a release coating 36, such as a spray or dip coating or a sleeve of PTFE, PFA, or MFA. Belt 24 may include a boron nitride or other filler to enhance thermal conductivity.

Heater 26 is positioned within inner loop 30 and in direct contact with belt 24. Heater 26 has a profile (e.g., flat or curved) generally corresponding to the travel path of belt 24 to provide an area contact rather than a line contact for more efficient thermal transfer. Heater 26 is in the form of a ceramic heater held in a heater housing 38 positioned within inner loop 30 and against belt 24. Belt 24 is somewhat loosely fit around heater housing 38, which is a high-temperature plastic body made of a liquid crystal polymer, about 30% glass-filled and 24% mineral-filled.

Pressure roller 28 defines a nip 42 with belt 24, through which print media 16 travels. Belt 24 is positioned adjacent toner side 22 of print media 16 as print media 16 is transported through nip 42, with pressure roller 28 on the opposite side of print media 16. As known to those skilled in the art, pressure roller 28 includes a metal core (not shown specifically), a compliant layer (not shown specifically) surrounding the core, and a release layer (not shown specifically) surrounding the compliant layer. The metal core is formed from a suitable metal that provides structural rigidity and stores thermal energy, such as extruded aluminum or steel. The compliant layer is formed from a material providing compliance of pressure roller 28, and can be in the form of silicone rubber, but may be formed of other resilient materials. Additionally, the release layer is in the form of a PFA sleeve, but may also be formed from a different material providing suitable release properties.

Belt 24 is a so-called "idling belt", having no drive rolls within inner loop 30. Belt 24 is driven by the rotation of pressure roller 28, through the driving association of belt 24 therewith in nip 42. Print media 16 is transported from PC member 12 to fuser 14 by a transport belt 44, and passes through nip 42.

During printing, fuser 14 fuses toner particles 20 to toner side 22 of print media 16. Heater 26 positioned within inner loop 30 of endless belt 24 is energized such that heater 26 provides a desired heat output. Heat is transferred principally via conduction from heater 26, through belt 24, and to the outer periphery of pressure roller 28. The outer surface of belt 24 is also the surface that transfers heat to toner particles 20, for fusing an image on print media 16. Print media 16 is transported through nip 42 between pressure roller 28 and belt 24. Heat is transferred from belt 24 to toner particles 20, to fuse the image on print media 16, and is additionally transferred to the backside of print media 16 from pressure roller 28, to assist in the fusing process. Compliant rubber layer 34 of belt 24 accommodates the varying thickness of toner particles on print media 16.

In a printing of transparencies, the toner must be fused sufficiently to become transparent, for the transmittance of light therethrough. The transmittance of transparency images is evaluated by measuring a transmittance ratio, which is the ratio of light transmitted through the transparency, with the image near a light source and the transmitted light measured at a distance from the light source. The toner must be smooth and free of surface defects that can scatter the light from the overhead projector, making the image look dirty or out of focus. If not properly fused, the transparency will not transmit the desired color image. However, if fused at too high temperature the toner will adhere to belt 24, potentially causing paper jams or print defects. Thus, in conventional fusers only a small window exists between the temperature required for proper fusing and the maximum temperature before offset and sticking may occur.

Figure 2:
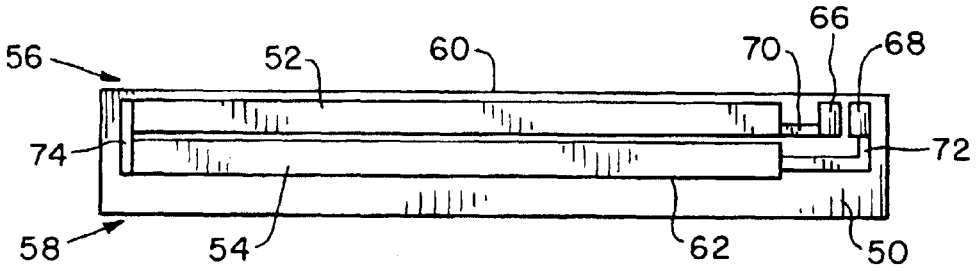
FIG. 2 is a plan view of a heater for the fuser shown in FIG. 1.
Figure 3:
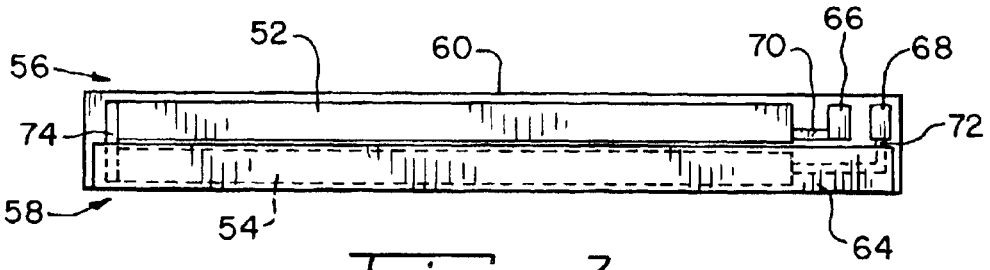
FIG. 3 is a plan view of an alternative heater for the fuser shown in FIG. 1.

Heater 26 of the present invention provides an increased operating window, thus allowing higher fusing temperatures while minimizing offset or sticking. As illustrated in FIGS. 2 and 3, heater 26 includes a ceramic base 50, which may be aluminum oxide, aluminum nitride or other similar ceramic. Two resistive heater traces 52, 54 are printed on ceramic base 50. In the exemplary embodiment shown, the resistive traces are two parallel traces each about three millimeters wide and separated by a gap of about 0.5 to 1.5 millimeters. AC current is passed through the resistive traces to generate heat. A glass coating is applied over resistive heater traces 52, 54, to insulate the AC current and provide a low friction surface for the belt to slide against.

Heater 26 has a nip entrance side 56 toward which print media 16 enters nip 42, and a nip exit side 58 from which print media 16 passes from nip 42. In the embodiment illustrated, heater trace 52 comprises an upstream trace and heater trace 54 comprises a downstream trace of heater 26. Consequently, upstream heater trace 52 includes a heater trace outer most entrance edge 60, and downstream heater trace 54 includes a heater trace outer most exit edge 62. Outer most entrance edge 60 is closer to nip entrance side 56 than outer most exit edge 62 is to nip exit side 58. With heater traces 52 and 54 biased toward nip entrance side 56, nip entrance side 56 is maintained at a higher temperature than the temperature of nip exit side 58. In this way, as the fusing/fused toner image passes through nip 42, a higher initial fusing temperature can be provided at nip entrance side 56. Within nip 42, cooling occurs so that offset or sticking does not result at nip exit side 58, as print media 16 passes from nip 42. By allowing some cooling within nip 42, a wider operating window is provided, to ensure proper, complete fusing of color images even on transparencies, with reduced potential for toner offset.

FIG. 3 illustrates an alternative embodiment for providing a lower temperature at nip exit side 58 compared to the temperature maintained at nip entrance side 56. A layer of increased insulation 64, which may be insulating tape, is interposed between heater 26 and belt 24, generally along a portion of nip exit side 58. Insulation 64 blocks some of the heat from being conducted to belt 24 along nip 42, and nip exit side 58 will thus be cooler than nip entrance side 56. Instead of insulation 64, a thicker top glass covering can be used at nip exit side 58, to reduce the conduction of heat to belt 24. As yet another alternative for providing more heat at nip entrance side 56 than at nip exit side 58, heater traces of different resistance can be used.

Two heater traces 52 and 54 have been illustrated, and include electrical contact pads 66 and 68 with conductive traces 70 and 72 connecting contact pads 66 and 68 to heater traces 52 and 54, respectively. A bridging conductive trace 74 is provided between heater traces 52 and 54. However, it should be understood that a single heater trace also can be used, biased toward nip entrance side 56. Further, more than two heater traces can be used, so long as the heater traces are biased toward nip entrance side 56, and an outermost entrance edge 60 of the heater traces is nearer to nip entrance side 56 than an outer most exit edge 62 is to nip exit side 58. Alternatively, insulation 64 can be used in conjunction with heater traces biased toward nip entrance side 56, or with heater traces otherwise positioned, and insulation 64 will provide a cooler nip exit side 58 than the nip entrance side 56.

Media velocity variation is a problem for fusers with idling belts because the drive side, that is pressure roller 28, is not held at a constant temperature. Depending upon the target operating temperature, the temperature of pressure roller 28 can range from about 50° C. to about 130° C., which translates into a significant increase in diameter of pressure roller 28 due to thermal expansion of the materials in the roll. As a result, a speed mismatch can occur between the speed of transport belt 44 and the speed of belt 24 through fuser nip 42. Machine architectures, cost and weight considerations sometimes necessitate one drive motor for operating both transport belt 44 and fuser 14, and the gear train connecting the two systems can be designed for only one speed. It is desirable that belt fuser 14 never tug on print media 16. Hence, the minimum speed of transport belt 44 matches the fastest speed of fuser nip 42, which occurs at high temperatures of pressure roller 28. For lower temperatures, the print media forms a bubble to act as a buffer between the systems. Heavier weight print media 16 does not buckle readily. While alternative methods can be used to solve the velocity mismatch problem, such as increasing the distance between the transport belt and fuser, or providing separate drive and controls for the two systems independently, such methods are expensive.

Figure 5:
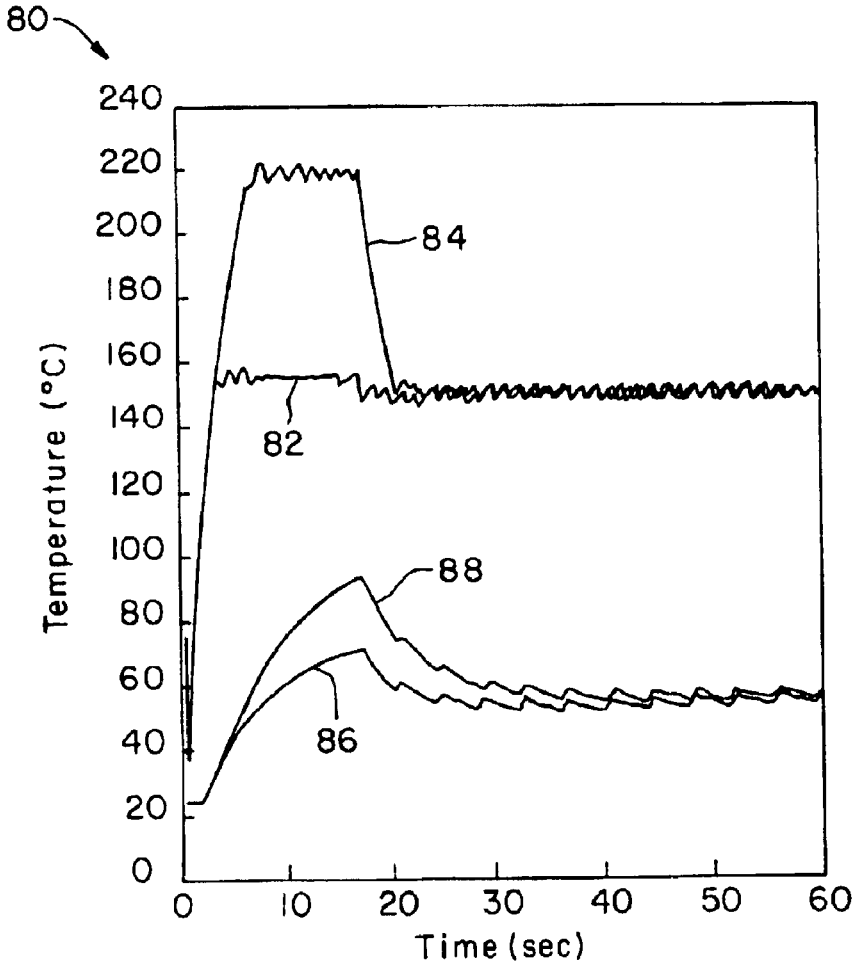
FIG. 5 is a graphical representation of one of the operating principles of the present invention.

In accordance with the present invention, several operating method variations are used to minimize the temperature range experienced by pressure roller 28 under various operating conditions. During warm-up, it is known to provide a minimal heater temperature over-shoot, such as about 5° C. to about 10° C. above the normal run temperature to which the heater set. The temperature overshoot is provided to boost the temperature quickly before print media 16 enters nip 42. In accordance with the present invention, rather than the approximate 10° C. temperature boost before printing the first page, the present invention uses an overshoot of at least about 25° C., preferably at least about 40° C., and more preferably at least about 70° C. This allows faster heating of the surfaces in the nip, and attainment of temperatures closer to a steady state pressure roller temperature before the first piece of media arrives at the nip. FIG. 5 is a graph 80 illustrating results from trials using warm-ups of seventeen seconds for both a standard operation and a modified operation in accordance with the present invention. Following the seventeen second warm-up, the heater set temperature for both processes was 150° C. Line 82 represents a standard heater warm-up, with a 5° C. heater temperature boost during warm-up, and line 84 represents a modified heater warm-up, with a 70° C. heater temperature boost during warm-up. The temperatures of pressure roller 28 for the standard and modified procedures are illustrated by lines 86 and 88, respectively. The modified procedure of the present invention achieved a more consistent temperature for pressure roller 28, at or near the target temperature as the first print media 16 passed through nip 42, while the standard procedure resulted in a 4° C. lower minimum pressure roller temperature near the start of the print job, increasing velocity variation.

In accordance with another aspect of the present invention, the maximum temperature attained by pressure roller 28 is minimized. Successive print jobs consisting of one or two pages, with a pause between jobs, can result in the temperature of pressure roller 28 increasing significantly above the steady state temperature, as energy is put into the pressure roller during the small jobs with little taken out during fusing of only one or two pieces of media. Minimizing the effect of "one page and pause" print jobs can reduce the temperature swing by 25° C., and speed variations to about 0.71%. To minimize the effect of "one page and pause" print jobs, the number of individual pieces of media in each print job is ascertained. Print jobs of less than three individual pieces of print media 16 are accumulated, until three or more pieces of print media 16 can be printed consecutively. If printer 10 is sent multiple jobs or multiple page jobs of three or more pages, the jobs are printed without delay because such jobs remove as much energy from pressure roller 28 as jobs of that type put into pressure roller 28, and the temperature of pressure roller 28 does not climb above the steady state temperature. If one or two print jobs have less than three total pieces of media, and no subsequent job is received after a given time interval, the job is printed with minimal effect. The overheating effect is seen only when small jobs are received in rapid succession, as a result of the brief pause between jobs, and energizing of the heater during the job, which may put more energy into pressure roller 28 than is taken out by the print job.

In accordance with a further aspect of the present invention, an existing pressure roller temperature is determined and compared to a known pressure roller steady state set temperature for proper fusing. Heater 26 is energized only if the pressure roller existing temperature is below the pressure roller steady state temperature by an amount related to the ramp rate of the heater, so that the temperature gain by pressure roller 28 does not exceed the pressure roller steady state temperature, or some acceptable temperature above the pressure roller steady state temperature, before the print media reaches fuser nip 42. For example, if the ramp rate of the heater will cause a temperature gain of 10° C. from the time the heater is energized until the media reaches nip 42, energizing the heater can be delayed until the existing temperature determined for pressure roller 28 is at least 10° C. or more below the steady state temperature for pressure roller 28. The delay causes pressure roller 28 to reach the desired temperature at the same time as media 16 enters nip 42. Therefore, no extra energy is put into pressure roller 28.

The existing temperature of pressure roller 28 can be determined by monitoring the rate of change of a thermistor after the heater has been turned off. Another method of estimating the temperature of pressure roller 28 is to monitor the printed pages. Knowing that the temperature of pressure roller 28 increases 10° C. after a job is sent, an estimated pressure roller temperature can be used to prevent pressure roller 28 from exceeding the steady state pressure roller temperature. A print job is delayed until the temperature of pressure roller 28 drops 10° C. below the pressure roller steady state temperature. The desired temperature will then be reached after the heater is energized and printing started.

Fuser 14 is compact in size, has low thermal mass, and the distance between the surface of heater 26 and print media 16 is small. Energy moves quickly from heater 26 to the media. If not controlled properly, a sudden rush of energy causes a rapid temperature rise, which can create a horizontal print defect. To eliminate the defects, the heater supply voltage is modulated to reduce the sudden power surges that cause temperature spikes. One solution, which causes other problems and potential defects, is to modulate the power so that the heater is always on, but at a lower average power. This, however, is expensive and not always an acceptable solution.

So-called "bang-bang" controls can be used, in which the heater is energized with full power applied. Each time the heater turns on the temperature suddenly increases, causing a horizontal line defect in the scan direction. Modulating the power eliminates the horizontal line defects.

A preferred method for modulating the power to heater 26 is a so-called "integer half-cycle" procedure. Integer half-cycle modulation switches the power to the heater at selected power cycle zero crossings. Every time the voltage passes through the zero crossing, the control system has the option to energize the heater or de-energizing the heater. In a preferred configuration, the control algorithm has the option of energizing the heater for none, 1, 2 or 3 of every three successive half-cycles. For standard weight print media 16, heater 26 is energized for only one of every three half-cycles, and heater power is reduced by two-thirds. For heavy weight print media 16, heater 26 is energized for two of every three successive half-cycles, and heater power is reduced by one-third. Only during warm-up from a cold start is heater 26 energized for three of three half-cycles.

The present invention provides an efficient color printer-suitable for printing color transparencies, which overcomes many of the problems associated with other printers, such as poor transmittance and halos on transparencies, poor print quality, poor toner release and media velocity variations.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of fusing toner particles to print media in a color electrophotographic printer, comprising the steps of:

providing a heater within a loop of an endless belt, said belt having a compliant layer therein;

energizing the heater;

transferring heat via conduction from said heater, through said belt, and to a pressure roller against said belt;

de-energizing and re-energizing said heater for selective current half-cycles to reduce the suddenness of heat transfer through said belt; and transporting the print media through a nip defined between said belt and said pressure roller; including accumulating print jobs of less than three individual pieces of print media, and transporting the print media through the nip in batches of greater than three individual pieces of print media.

2. A method of fusing toner particles to print media in a color electrophotographic printer, comprising the steps of:

providing a heater within a loop of an endless belt, said belt having a compliant layer therein;

energizing the heater;

transferring heat via conduction from said heater, through said belt, and to a pressure roller against said belt;

de-energizing and re-energizing said heater for selective current half-cycles to reduce the suddenness of heat transfer through said belt;

transporting the print media through a nip defined between said belt and said pressure roller;

determining a heater set temperature for continuous operation; and preheating the nip by energizing the heater to at least about 25° C. above the heater set temperature.

3. The method of fusing of claim 2, including preheating the nip by energizing the heater to at least about 70° C. above the heater set temperature.

4. The method of fusing of claim 2, including preheating the nip by energizing the heater to at least about 40° C. above the heater set temperature.

5. A method of fusing toner particles to print media in a color electrophotographic printer, comprising the steps of:

providing a heater within a loop of an endless belt, said belt having a compliant layer therein;

energizing the heater;

transferring heat via conduction from said heater, through said belt, and to a pressure roller against said belt;

de-energizing and re-energizing said heater for selective current half-cycles to reduce the suddenness of heat transfer through said belt;

transporting the print media through a nip defined between said belt and said pressure roller; and determining a fuser pressure roller steady state temperature, determining a fuser pressure roller existing temperature, and delaying said step of energizing the heater if the existing fuser pressure roller temperature is not at least about 10° C. below the pressure roller steady state temperature.

6. The method of fusing of claim 5, including providing a ceramic heater for said heater within a loop.

7. The method of claim 5, including:

determining a set temperature for proper fusing;

detecting an existing temperature;

comparing the set temperature to the existing temperature;

transporting the print media to the nip; and delaying said step of re-energizing the heater until the existing temperature falls below the set temperature by an amount about equal to a temperature rise resulting from said re-energizing before the print media reaches the nip.

8. A method of fusing toner particles to print media in an electrophotographic printer, comprising the steps of:

providing a heater within an inner loop of an endless belt, and a pressure roller defining a nip with the belt;

determining a heater set temperature for continuous operation for proper fusing;

preheating the belt and pressure roller by energizing the heater to a temperature at least about 25° C. above the set temperature;

transporting the print media through the nip defined between said belt and said pressure roller; and fusing the toner particles to the print media using heat from said pressure roller and said belt.

9. The method of fusing of claim 8, said preheating the belt and pressure roller performed by energizing the heater to a temperature at least about 40° C. above the set temperature.

10. The method of fusing of claim 8, said preheating the belt and pressure roller performed by energizing the heater to a temperature at least about 70° C. above the set temperature.

11. The method of fusing of claim 8, including the step of accumulating print jobs of less than three individual pieces of print media, and transporting the print media through the nip in batches of greater than three individual pieces of print media.

12. The method of fusing of claim 8, including steps of:

determining a fuser pressure roller steady state temperature for proper fusing;

determining a fuser pressure roller existing temperature;

comparing the pressure roller steady state temperature to the pressure roller existing temperature;

energizing the heater if the pressure roller existing temperature is more than about 10° C. below the pressure roller steady state temperature; and delaying energizing the heater if the pressure roller existing temperature is not at least about 10° C. below the steady state temperature.

13. A method of fusing toner particles to print media in an electrophotographic printer, comprising the steps of:

providing a heater within an inner loop of an endless belt, and a pressure roller defining a nip with the belt;

determining a fuser pressure roller steady state temperature for proper fusing;

determining a fuser pressure roller existing temperature;

comparing the pressure roller steady state temperature to the pressure roller existing temperature;

energizing a heater within an inner loop of an endless belt if the pressure roller existing temperature is more than about 10° C. below the pressure roller steady state temperature;

delaying energizing the heater if the pressure roller existing temperature is not at least about 10° C. below the steady state temperature;

transporting the print media through the nip defined between said belt and said pressure roller; and fusing the toner particles to the print media using heat from said pressure roller and said belt.

14. The method of fusing of claim 13, including the step of ascertaining the number of individual pieces of print media in a print job, and accumulating print jobs until a total number of at least three pieces of print media are in the accumulated print jobs.

15. The method of claim 13, including:

determining a set temperature for proper fusing;

detecting an existing temperature;

comparing the set temperature to the existing temperature;

transporting the print media to the nip; and delaying said step of re-energizing the heater until the existing temperature falls below the set temperature by an amount about equal to a temperature rise resulting from said re-energizing before the print media reaches the nip.

16. A method of fusing toner particles to print media in an electrophotographic printer having an idling belt defining a loop, a heater in heat transfer relationship with the belt inside the loon and a pressure roller defining a nip with the belt, said method comprising the steps of:

energizing the heater to heat the belt and pressure roller;

periodically de-energizing and re-energizing the heater;

determining a set temperature for proper fusing;

detecting an existing temperature;

comparing the set temperature to the existing temperature;

transporting the print media to the nip;

delaying said step of re-energizing the heater until the existing temperature falls below the set temperature by an amount about equal to a temperature rise resulting from said re-energizing before the media reaches the nip;

fusing the toner particles to the print media using heat from said pressure roller and said belt; and ascertaining the number of individual pieces of print media in a print job, and accumulating print jobs until a total number of at least three pieces of print media are in the accumulated print jobs.

17. A method of fusing toner particles to print media in an electrophotographic printer having an idling belt defining a loop, a heater in heat transfer relationship with the belt inside the loop and a pressure roller defining a nip with the belt, said method comprising steps of:

determining a fuser pressure roller existing temperature;

comparing the pressure roller existing temperature to a pre-established temperature limit;

ascertaining the number of individual pieces of media in a print job; and accumulating print jobs until a total number of at least three pieces of print media are in the accumulated print jobs if the pressure roller existing temperature exceeds the pre-established temperature limit.

* * * * *